United States Patent [19]

Kobayashi

[11] 4,026,297

[45] May 31, 1977

[54] INFANT'S TEETHER TOY

[76] Inventor: Keiji Kobayashi, P.O. Box 687, Pahoa, Hawaii 96778

[22] Filed: July 14, 1975

[21] Appl. No.: 595,879

[52] U.S. Cl. ..... 128/359; 46/220

[51] Int. Cl.[2] ..... A61J 17/00

[58] Field of Search ..... 46/220; 128/359, 360, 128/303; 242/118, 118.2, 118.4, 118.7; D34/15 AG; D83/8 C

[56] References Cited

UNITED STATES PATENTS

| | | | |
|---|---|---|---|
| 301,573 | 7/1884 | Crich | 242/118.4 X |
| 2,112,316 | 3/1938 | Turner | 128/359 X |
| 2,472,248 | 6/1949 | Cox | 242/118.7 UX |
| 2,654,549 | 10/1953 | Rappleyea | 242/118.7 |
| 3,584,819 | 6/1971 | Brough | 242/118.7 X |
| D157,464 | 2/1950 | Biggs | D34/15 AG X |
| D159,667 | 8/1950 | Ross | D34/15 AG |

FOREIGN PATENTS OR APPLICATIONS

| | | | |
|---|---|---|---|
| 820,810 | 9/1959 | United Kingdom | 242/118.7 |

*Primary Examiner*—Channing L. Pace
*Attorney, Agent, or Firm*—William B. Walter

[57] ABSTRACT

A drum shaped infant's teething device consisting of a soft non-toxic rubberlike hollow toy having thick walls and generally toroidal rims about the size of teething rings which rims are integral with the drum shaped toy and yet stand out from the drum for teething purposes.

4 Claims, 3 Drawing Figures

INFANT'S TEETHER TOY

BACKGROUND

The need for a soft toy which a baby can safely suck and chew on during the teething stage has been well demonstrated throughout the ages. The type of teething ring which is in the shape and size of a bracelet, about three-eighth inch (1 centimeter) in minor diameter and 4 inches (10 centimeters) in major diameter has been popular, but the parents continually seek new toys which will interest and amuse the infant and at the same time be safe. Toys of the prior art devised with this in mind have included the teething ring combined with a ball as in U.S. Pat. No. 2,717,473 thus having greater bulk to attract the infant yet being difficult to roll and also suspend on a string over the young baby. Other attempts of the prior art such as the complex ball-shaped teething ring of U.S. Pat. No. 3,633,587 will roll easily and could be tied to a string to be dangled over the young baby, yet appears to be difficult to keep clean and sanitary.

BRIEF SUMMARY OF THE INVENTION

It is an object of this invention to provide an improved teething toy which will interest the baby, which is safe, readily cleaned, easily rolled, foat in a bathtub, provide surfaces for teething, and be capable of suspending by a string over the baby.

This invention is a hollow water-tight drum-shaped soft rubbery toy about four inches (10 cm.)in diameter and 2 inches (5 cm.) wide having rounded rims in the shape and cross-section of the conventional teething ring, which rounded rims are integral with the drum-shaped toy.

DETAILED DESCRIPTION OF THE INVENTION

Figure 1:
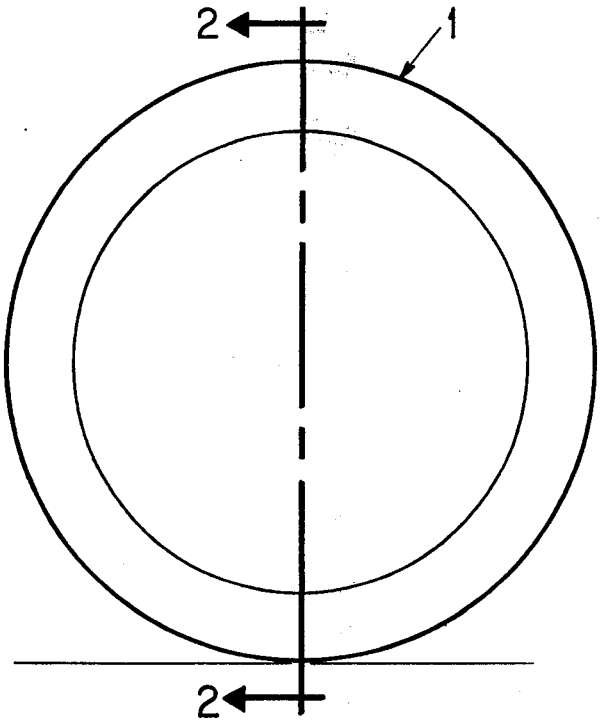
FIG. 1 shows the improved teether toy in elevation and resting on a flat surface.

Referring to the drawings in FIG. 1 it is seen that the improved teether toy 1 is circular in shape as seen from the side and will remain upright when at rest on a horizontal surface in the manner of a wide wheel or drum so that it can be rolled.

Figure 2:
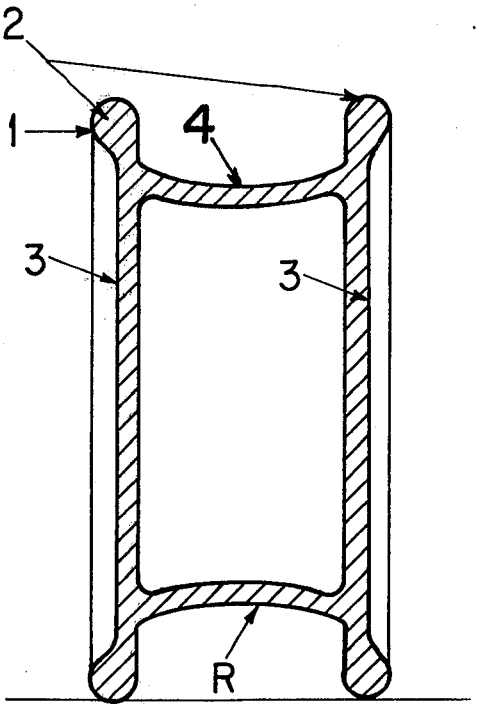
FIG. 2 is a cross-section on the line 2—2 of FIG. 1.

The cross-sectional view in FIG. 2 shows the drum shape of the toy 1 having two integral toroidal rims 2 standing out from the generally flat side walls 3 and the wall 4 of the drum or spacer, the body of which has as its external wall 4 a surface of revolution, the curve of which has a radius R of approximately 2 inches (5 cm.) and such that the arc of the curve is swung from a center which is outside the surface of revolution so that the diameter of the spacer is less at the midway point than at the juncture of the spacer with each ring 2. The rims 2 need not be exactly circular in cross-section but are preferably rounded so as to prevent injury to the baby. Although this surface 4 can be cylindrical with a constant diameter, the shape shown is preferred so as to allow the baby to more easily hold onto the toy 1 and so that the walls 4 might more easily collapse when squeezed.

Since the toroidal rims 2 stand out from the drum surface the rims 2 may be easily chewed on by the baby as with a free ring. However, because of the bulk of the toy and because it has a less regular shape than a ball, the baby cannot introduce enough of it into his mouth to choke on it.

Because the rims 2 are set out from the drum ends 3, the flat surfaces or heads 3 of the drum are recessed and any ornamental design thereon is somewhat protected from wear. This is also somewhat true of the concave cylindrical surface 4. Preferably my improved teething toy is made of a soft non-toxic vinyl or similar product having approximately one-sixteenth to one-eigth inch (0.16 to 0.32 cm.) walls, a rim major diameter of 4 inches (10 cm.), a drum width of 2 inches (5 cm.), cross-sectional or minor diameter of the rims of about five-sixteenth of an inch (0.8 cm.), and a minimum drum diameter of about 2 13/16 inches (7 cm.)

Figure 3:
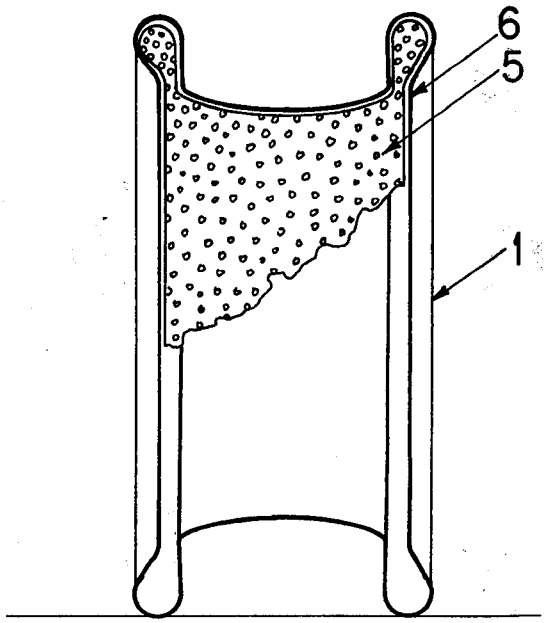
FIG. 3 is an elevation of the toy as seen at right angles from the view of FIG. 1 and with a portion cut away to show the interior construction of an alternate embodiment.

In another embodiment of my invention the toy would be moulded from a soft non-toxic low density rubbery material such as a foamed elastomer 5 and then covered with a non-toxic flexible tough coating 6 so as to obtain the characteristics of softness, non-toxicity, and flotation in water. Such an embodiment would have the same shape as the hollow version. A typical cutaway view is shown in FIG. 3. As can be seen in FIGS. 2 and 3, the outside surfaces of the toy 1 are continuous and contain no holes such as the central bore of a spool and thus provide no recesses to harbor extraneous materials which might be harmful to the infant.

In summary, features and characteristics of my improved teether toy are the following:

1. Babies like to play with it.
2. Being light and watertight, it floats and is thus a good bathtub toy.
3. Being round, soft, and large enough it is a safe toy.
4. It is light in weight and thus cannot easily harm the baby or interior furnishings.
5. It is easily rolled.
6. It provides rounded surfaces well shaped for teething.
7. A string can be easily tied around it for suspension over the baby.
8. All of its external surfaces are readly accessible to facilitate cleaning.

I claim:

1. An infant's teether toy comprising a flexible soft drum-shaped article having a generally flat recessed head and an integral outstanding rounded rim of greater diameter than the remainder of the drum-shaped article on each end to serve as teething rings and surfaces on which the article may be rolled wherein the external surfaces of the article are continuous whereby extraneous materials will not be retained in holes to harm the infant.

2. An infant's teether toy as claimed in claim 1 wherein the drum-shaped surface of the article between the two rims is a surface of revolution such that the outside diameter at the midway point between the rims is less than at the ends where joined to the rims whereby the toy may be more easily grasped and squeezed by the infant.

3. An infant's teether toy comprised of two soft pliable toroidal teething rings held in parallel relationship by a soft pliable spacer integral with the teething rings and joined thereto near the inside diameter of each ring wherein the outside surface of said integral spacer is a surface of revolution such that the outside diameter of the spacer at the midway point between the rings is less than at the ends where joined to the rings whereby each teether ring stands out from the spacer so as to present a surface for the infant to chew.

4. An infant's teether toy comprised of two soft pliable toroidal teething rings held in parallel relationship by a soft pliable spacer integral with the teething rings and joined thereto near the inside diameter of each ring wherein the teething rings stand out from the ends and body of the spacer to present a surface for the infant to chew.

* * * * *